US006283928B1

(12) United States Patent
Wang

(10) Patent No.: US 6,283,928 B1
(45) Date of Patent: Sep. 4, 2001

(54) MASSAGE APPARATUS

(76) Inventor: Kuo-An Wang, No. 77, Sec. 1, Ling-An Rd., Tainan City (TW)

( * ) Notice: Subject to any disclaimer, the term of this patent is extended or adjusted under 35 U.S.C. 154(b) by 0 days.

(21) Appl. No.: 09/522,757

(22) Filed: Mar. 10, 2000

(51) Int. Cl.[7] ..... A61H 7/00

(52) U.S. Cl. ..... 601/99; 601/98; 601/101; 601/103

(58) Field of Search ..... 601/97–103, 112, 601/113, 115, 126, 116, 128

(56) References Cited

U.S. PATENT DOCUMENTS

| | | | | |
|---|---|---|---|---|
| 5,179,940 | * | 1/1993 | Barreiro | 128/33 |
| 5,460,598 | * | 10/1995 | Yamasaki et al. | 601/99 |
| 5,462,516 | * | 10/1995 | Anderson | 601/99 |
| 5,464,382 | * | 11/1995 | Wang | 601/99 |
| 6,039,705 | * | 3/2000 | Wu | 601/99 |

* cited by examiner

*Primary Examiner*—Justine R. Yu

(74) *Attorney, Agent, or Firm*—Ladas & Parry

(57) ABSTRACT

A massage apparatus includes an upright frame member having a parallel pair of vertically extending guide rails, and an externally threaded screw shaft mounted on the frame member and disposed parallel to and between the guide rails. A slide frame extends between the guide rails and is coupled slidably thereto so as to be movable upwardly and downwardly therealong. A massage drive unit is mounted on the slide frame, and includes an upright rotatable drive shaft having a lower end provided with a first gear and an upper end provided with a second gear, and a massaging roller assembly driven by axial rotation of the drive shaft for imparting a massaging action. A first transmission belt is coupled to a motor on a lower frame part of the slide frame and the first gear so as to enable the motor to drive the drive shaft to rotate axially. A coupling unit is mounted on the upper frame part of the slide frame, and includes a rotary member coupled threadedly and rotatable relative to the screw shaft. A second transmission belt is coupled to the second gear and the rotary member so as to enable the second gear to drive rotation of the rotary member, thereby enabling the rotary member to move upwardly and downwardly along the screw shaft to result in corresponding upward and downward movement of the slide frame.

6 Claims, 4 Drawing Sheets

MASSAGE APPARATUS

BACKGROUND OF THE INVENTION

1. Field of the Invention

The invention relates to a massage apparatus, more particularly to one that incorporates a single motor for operating a massage drive unit and for moving a slide frame upwardly and downwardly.

2. Description of the Related Art

In a conventional massage apparatus, a massage drive unit is mounted on a slide frame that is movable upwardly and downwardly. FIG. 1 illustrates a conventional massage apparatus that employs a single motor 15 to operate a massage drive unit 14 and to move a slide frame 13 upwardly and downwardly. The conventional massage apparatus includes an upright frame member 11 having a parallel pair of vertically extending guide rails 111. An externally threaded screw shaft 12 is mounted on the frame member 11 with the use of screw fasteners 113, and is disposed parallel to and between the guide rails 111. The slide frame 13 extends between the guide rails 111 and is coupled slidably thereto so as to be movable upwardly and downwardly therealong. The motor 15 is secured on a support 22 that is fixed to a lower frame part of the slide frame 13. The massage drive unit 14 is mounted on the slide frame 13. A coupling member 16 is mounted on a bracket 21 that is fixed to the lower frame part of the slide frame 13. The coupling member 16 is rotatable about a vertical axis, and is coupled threadedly to the screw shaft 12. The slide frame 13 further has an upper frame part provided with a screw guide 17 that permits extension of the screw shaft 12 therethrough.

The massage drive unit 14 includes an upright rotatable drive shaft 141. A lower end of the drive shaft 141 is provided with a drive gear 142. The motor 15 is coupled to the coupling member 16 on the screw shaft 12 via a transmission belt 18 for driving rotation of the coupling member 16 about the axis of the screw shaft 12. The coupling member 16 is coupled to the drive gear 142 via a transmission belt 19 for driving the drive shaft 141 to rotate axially.

With further reference to FIG. 2, the bracket 21 is a generally U-shaped bracket with parallel upper and lower bracket parts 211. The coupling member 16 is disposed rotatably between the upper and lower bracket parts 211, and is formed with a vertically extending screw hole 161 therethrough for threaded engagement with the screw shaft 12. The screw shaft 12 further extends through aligned holes 212 in the upper and lower bracket parts 211. The coupling member 16 is formed with an upper gear portion 162 for coupling with the transmission belt 18, and a lower gear portion 163 for coupling with the transmission belt 19. When the coupling member 16 is driven rotatably by the motor 15 via the transmission belt 18, because the screw shaft 12 is stationary relative to the frame member 11, the coupling member 16 will be able to move upwardly and downwardly along the screw shaft 12, thereby resulting in corresponding upward and downward movement of the slide frame 13 relative to the guide rails 111. Moreover, when the coupling member 16 rotates, the drive shaft 141 of the massage drive unit 14 also rotates by virtue of the engagement among the lower gear portion 163, the transmission belt 19 and the drive gear 142, thereby enabling a massaging roller assembly 143 of the massage drive unit 14 to impart a predetermined massaging action, such as a kneading or tapping massaging action.

Some of the drawbacks of the above-described conventional massage apparatus are as follows:

1. Sliding movement of the slide frame 13 and operation of the massage drive unit 14 are possible due to the presence of the coupling member 16. However, such an arrangement results in stress concentration on the coupling member 16, which can lead to rapid wearing of the same.

2. When replacing the transmission belts 18, 19 due to wear, it is necessary to remove the screw shaft 12 from the frame member 11, the coupling member 16 and the screw guide 17, and to remove the coupling member 16 from the bracket 21, thereby resulting in a great deal of inconvenience.

SUMMARY OF THE INVENTION

Therefore, the main object of the present invention is to provide a massage apparatus in which stress that results due to sliding movement of the slide frame and operation of the massage drive unit can be evenly dispersed.

Another object of the present invention is to provide a massage apparatus in which replacement of transmission belts can be facilitated.

According to the present invention, a massage apparatus comprises:

- an upright frame member having a parallel pair of vertically extending guide rails;
- an externally threaded screw shaft mounted on the frame member and disposed parallel to and between the guide rails;
- a slide frame extending between the guide rails and coupled slidably to the guide rails so as to be movable upwardly and downwardly along the guide rails, the slide frame having upper and lower frame parts;
- a motor mounted on the lower frame part of the slide frame;
- a massage drive unit mounted on the slide frame, the massage drive unit including an upright rotatable drive shaft having a lower end provided with a first gear and an upper end provided with a second gear, the massage drive unit further including a massaging roller assembly driven by axial rotation of the drive shaft for imparting a massaging action;
- a first transmission belt coupled to the motor and the first gear so as to enable the motor to drive the drive shaft to rotate axially, rotation of the drive shaft resulting in corresponding rotation of the second gear;
- a coupling unit mounted on the upper frame part of the slide frame, the coupling unit including a rotary member coupled threadedly and rotatable relative to the screw shaft; and
- a second transmission belt coupled to the second gear and the rotary member so as to enable the second gear to drive rotation of the rotary member about axis of the screw shaft, thereby enabling the rotary member to move upwardly and downwardly along the screw shaft to result in corresponding upward and downward movement of the slide frame relative to the guide rails.

In the preferred embodiment, the frame member further has top and bottom frame sections. The top frame section interconnects top ends of the guide rails, and has an intermediate portion with an upper shaft mounting plate mounted thereon. The upper shaft mounting plate is formed with an upper first notch that opens at a peripheral edge of the upper shaft mounting plate. The bottom frame section interconnects bottom ends of the guide rails, and has an intermediate portion with a lower shaft mounting plate mounted thereon. The lower shaft mounting plate is vertically aligned with the upper shaft mounting plate, and is formed with a lower first notch that is registered vertically with the upper first notch and that opens in a same direction as the upper first notch at a peripheral edge of the lower shaft mounting plate. The screw shaft has top and bottom end portions, each of which is extended through a respective one of the upper and lower first notches from the peripheral edge of a respective one of the upper and lower shaft mounting plates.

The rotary member is formed with a screw hole therethrough for threaded engagement with the screw shaft, and has an outer surface formed with a belt engaging groove for engagement with the second transmission belt. The coupling unit further includes a bracket mounted on the upper frame part of the slide frame. The bracket has parallel upper and lower bracket parts, each of which is formed with a second notch that is registered vertically with the upper and lower first notches and that opens in the same direction as the upper and lower first notches. The rotary member is disposed between the upper and lower bracket parts such that the screw shaft extends through the second notches in the upper and lower bracket parts. Bearing members are provided respectively on upper and lower ends of the rotary member. Cap members enclose respectively the bearing members. The cap members are retained removably and respectively on the upper and lower bracket parts, and retain rotatably the rotary member between the upper and lower bracket parts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
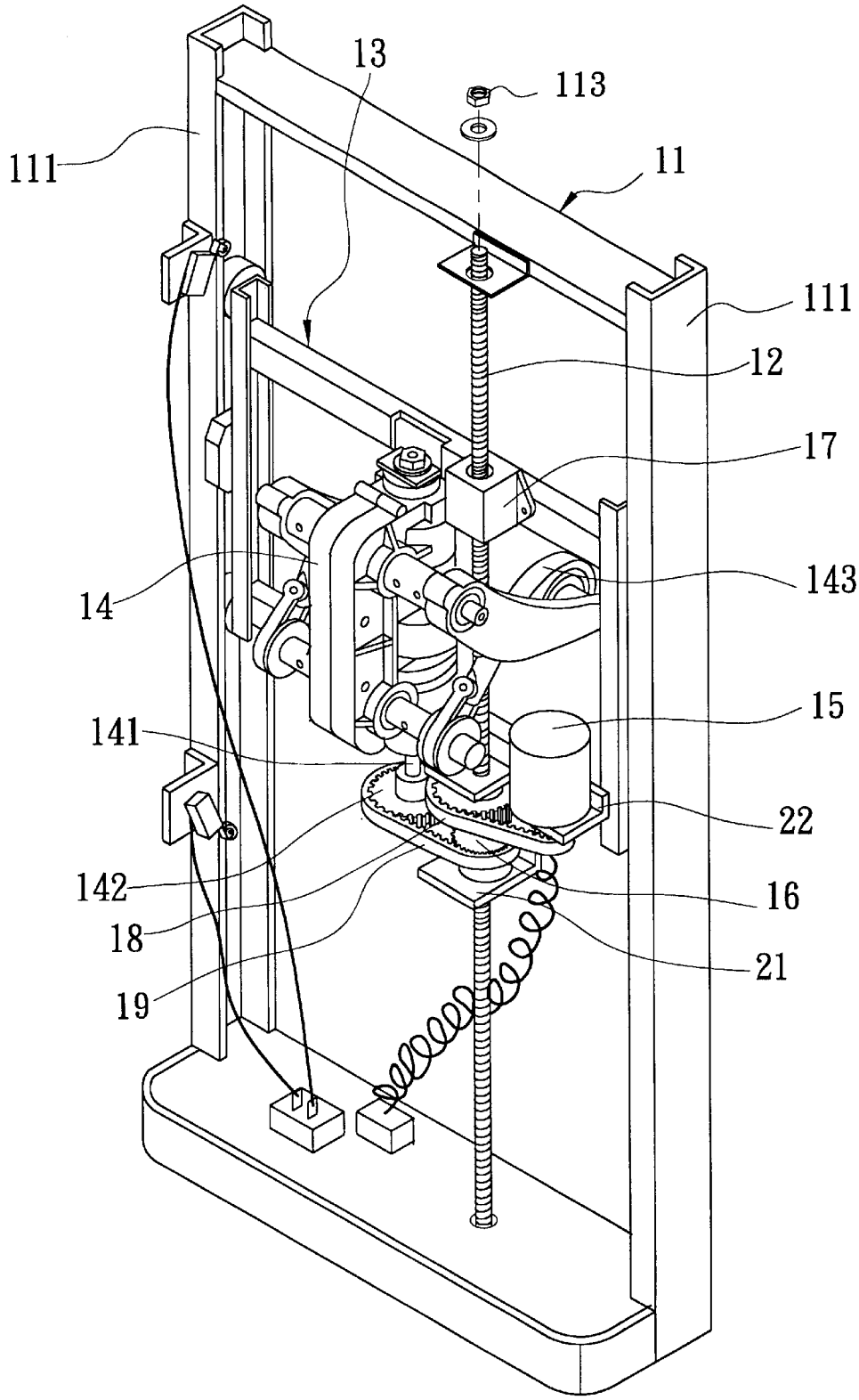
FIG. 1 PRIOR ART
FIG. 1 is a perspective view showing a conventional massage apparatus.
Figure 2:
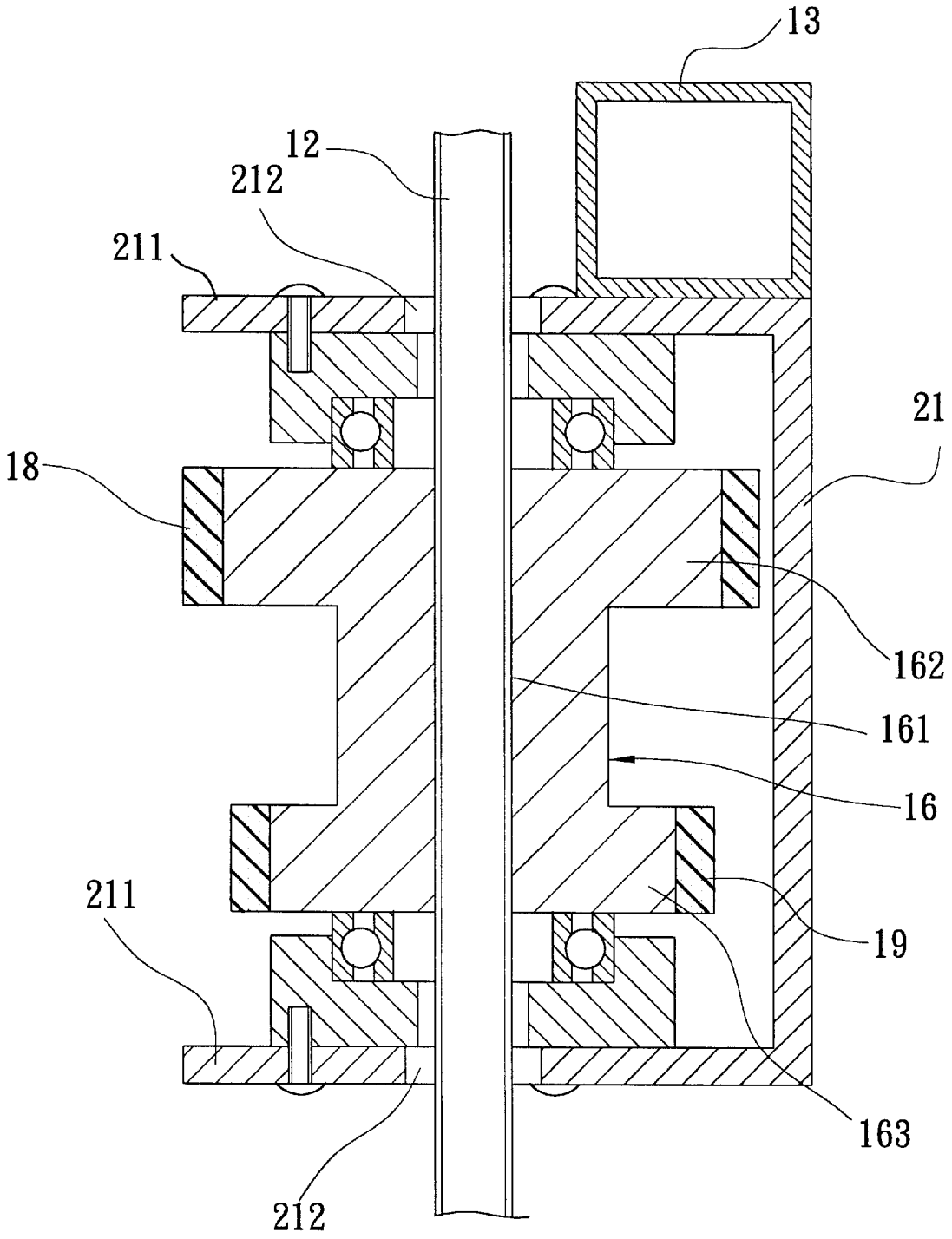
FIG. 2 PRIOR ART
FIG. 2 is a fragmentary sectional view of the conventional massage apparatus, illustrating how a coupling member thereof is installed.
Figure 3:
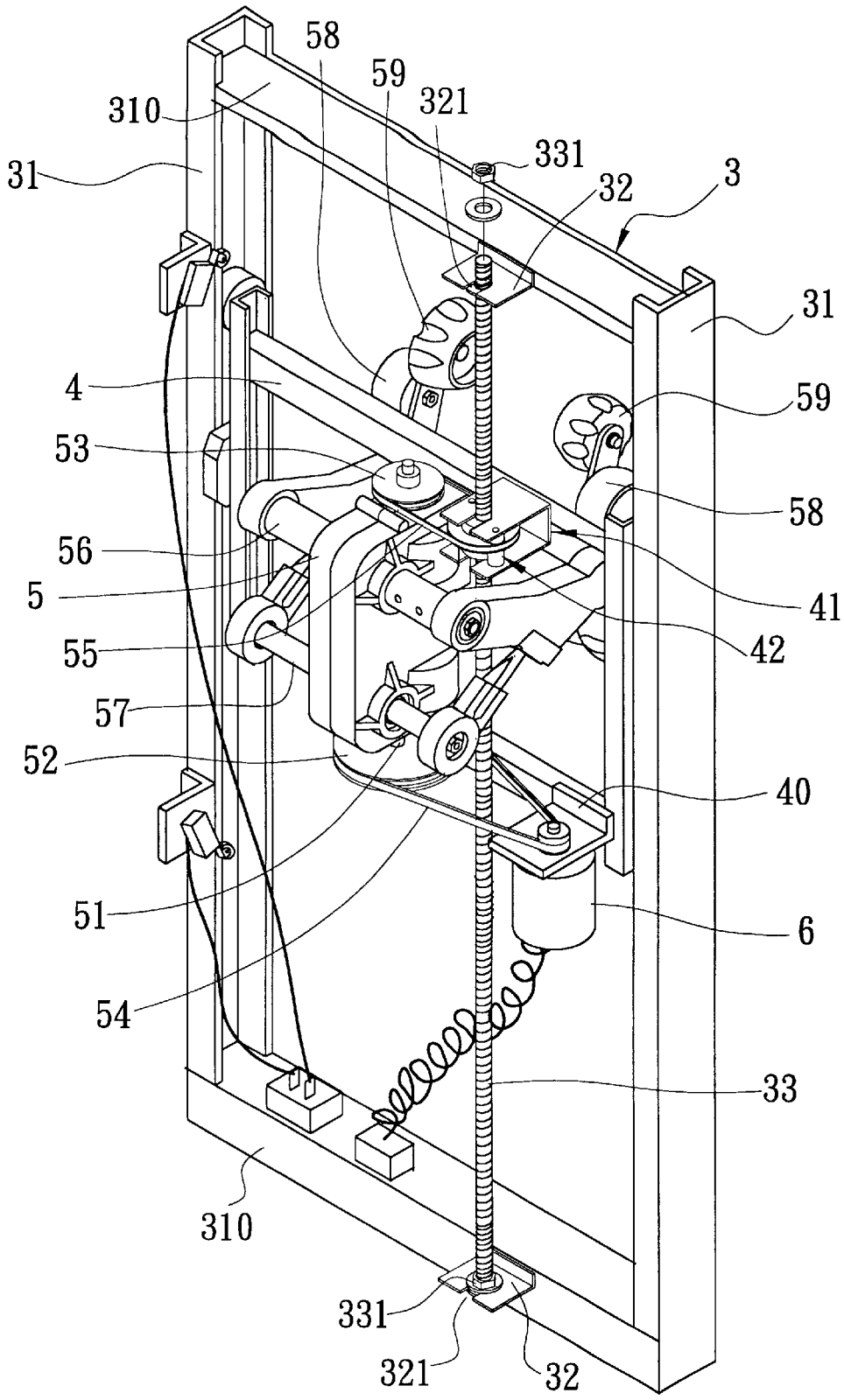
FIG. 3 is a perspective view showing the preferred embodiment of a massage apparatus according to the present invention.

Referring to FIG. 3, the preferred embodiment of a massage apparatus according to the present invention is shown to comprise an upright frame member 3 having a parallel pair of vertically extending guide rails 31, and top and bottom frame sections 310 that interconnect top and bottom ends of the guide rails 31, respectively. Each of a pair of vertically aligned upper and lower shaft mounting plates 32 is fixed to an intermediate portion of a respective one of the top and bottom frame sections 310. An externally threaded screw shaft 33 extends between the upper and lower shaft mounting plates 32, and is disposed parallel to the guide rails 31. A slide frame 4 extends between the guide rails 31 and is coupled slidably thereto so as to be movable upwardly and downwardly therealong. A support 40 is fixed to a lower frame part of the slide frame 4. A motor 6 is secured to the support 40. A massage drive unit 5 is mounted on the slide frame 4. A bracket 41 is fixed to an upper frame part of the slide frame 4.

The massage drive unit 5 includes an upright rotatable drive shaft 51. The drive shaft 51 has a lower end provided with a first gear 52, and an upper end provided with a second gear 53. A first transmission belt 54 couples the motor 6 to the first gear 52 so as to enable the motor 6 to drive the drive shaft 51 to rotate axially. Rotation of the drive shaft 51 results in corresponding rotation of the second gear 53. The massage drive unit 5 further includes a massaging roller assembly having upper and lower output shafts 56, 57 that are transverse to the drive shaft 51, and massaging roller units 58, 59 mounted on the upper and lower output shafts 56, 57. The upper and lower output shafts 56, 57 are coupled to the drive shaft 51 in a conventional manner so as to enable the massaging roller units 58, 59 to impart a predetermined massaging action, such as a kneading or tapping massaging action, when the upper and lower output shafts 56, 57 are driven by the drive shaft 51.

The upper and lower shaft mounting plates 32 are formed with vertically registered upper and lower first notches 321 that open in a same direction at a peripheral edge of the corresponding one of the shaft mounting plates 32, and that permit a respective one of top and bottom end portions of the screw shaft 33 to extend therethrough from the peripheral edge of the respective one of the shaft mounting plates 32. Screw fasteners 331 secure releasably the top and bottom end portions of the screw shaft 33 on the shaft mounting plates 32, respectively.

Figure 4:
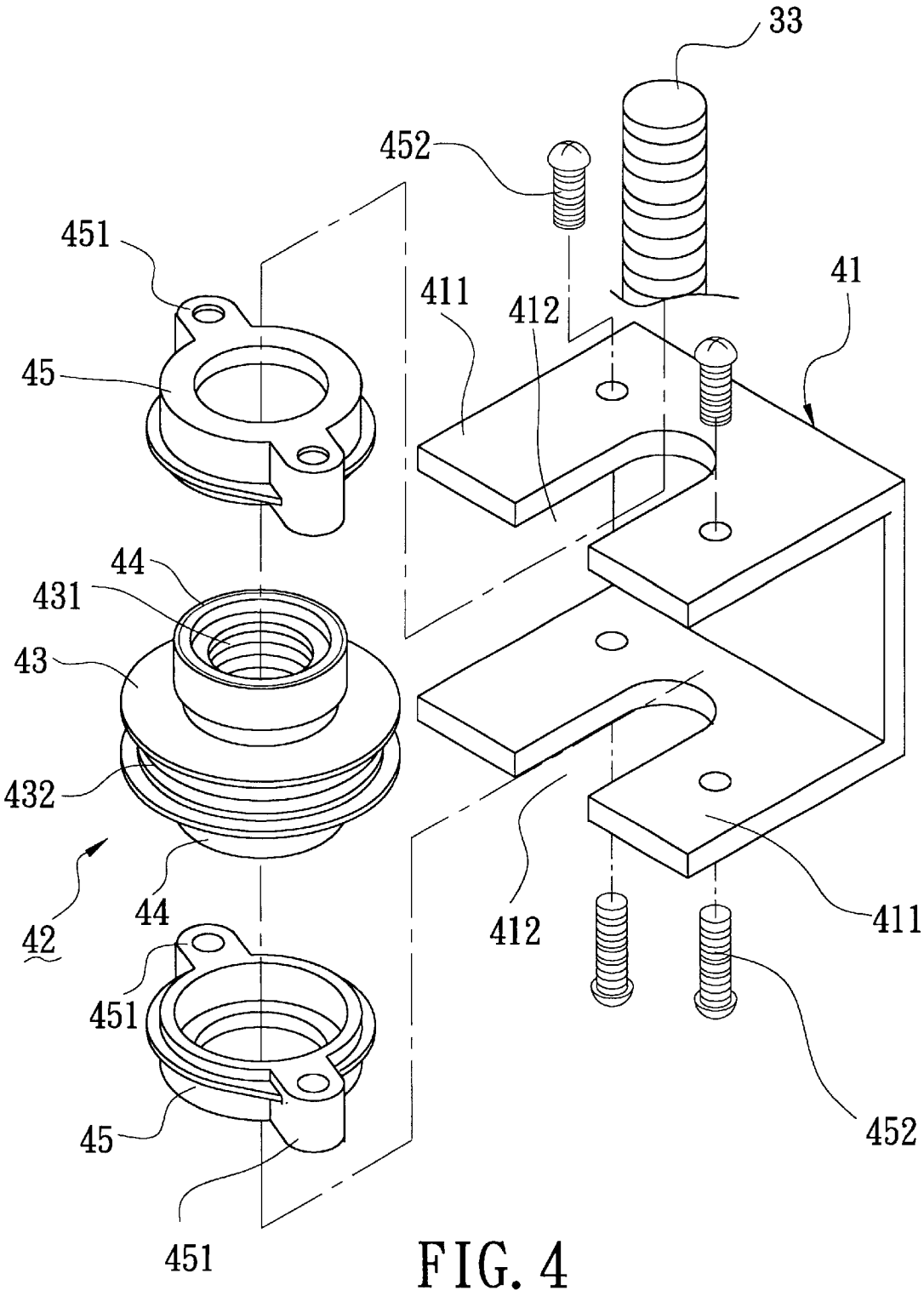
FIG. 4 is a fragmentary exploded perspective view illustrating a coupling unit of the preferred embodiment.

With further reference to FIG. 4, the bracket 41 is a generally U-shaped bracket with parallel upper and lower bracket parts 411. The upper and lower bracket parts 411 are formed with second notches 412 that are registered vertically with the first notches 321 and that open in the same direction as the first notches 321.

A coupling unit 42 is mounted on the bracket 41 and is disposed between the upper and lower bracket parts 411. The coupling unit 42 includes a rotary member 43, a pair of bearing members 44 provided respectively on upper and lower ends of the rotary member 43, and a pair of cap members 45 enclosing respectively the bearing members 44. The rotary member 43 is formed with a vertically extending screw hole 431 therethrough for threaded engagement with the screw shaft 33. Each of the cap members 45 is formed with a pair of radial lugs 451. Screws 452 pass through the upper and lower bracket parts 411 and engage the radial lugs 451 to retain removably and respectively the cap members 45 on the upper and lower bracket parts 411. The cap members 45 retain rotatably the rotary member 43 between the upper and lower bracket parts 411. The rotary member 43 further has an outer surface formed with a belt engaging groove 432. A second transmission belt 55 engages the rotary member 43 in the belt engaging groove 432 and couples the rotary member 43 to the second gear 53.

Therefore, when the motor 6 operates, the drive shaft 51 rotates by virtue of the engagement among the motor 6, the first transmission belt 54 and the first gear 52, thereby enabling the massaging roller units 58, 59 to impart the predetermined massaging action. At the same time, the second gear 53 rotates with the drive shaft 51. By virtue of the engagement among the second gear 52, the second transmission belt 55 and the rotary member 43, rotation of the second gear 53 results in corresponding rotation of the rotary member 43 about the axis of the screw shaft 33. Because the screw shaft 33 is stationary relative to the frame member 3, rotation of the rotary member 43 will enable the latter to move upwardly and downwardly along the screw shaft 33, thereby resulting in corresponding upward and downward movement of the slide frame 4 relative to the guide rails 31.

Some of the advantages of the massage apparatus of this invention are as follows:

1. Operating power for the massage drive unit 5 is provided via the first transmission belt 54 and the first gear 52 on the lower end of the drive shaft 51. Power for sliding movement of the slide frame 4 is provided via the second gear 53 on the upper end of the drive shaft 51, the second transmission belt 55, and the coupling unit 42 on the bracket 41. As such, stress can be distributed to the upper and lower ends of the drive shaft 51 to minimize wearing and prolong the service life of the massage apparatus of this invention.

2. When it is desired to replace the transmission belts 54, 55, the screws 452 and the screw fasteners 331 are loosened to permit removal of the screw shaft 33 from the upper and lower shaft mounting plates 32 and the upper and lower bracket parts 411 via the first and second notches 321, 412. Replacement of the transmission belts 54, 55 is thus facilitated in the massage apparatus of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A massage apparatus comprising:

an upright frame member having a parallel pair of vertically extending guide rails;

an externally threaded screw shaft mounted on said frame member and disposed parallel to and between said guide rails;

a slide frame extending between said guide rails and coupled slidably to said guide rails so as to be movable upwardly and downwardly along said guide rails, said slide frame having upper and lower frame parts;

a motor mounted on said lower frame part of said slide frame;

a massage drive unit mounted on said slide frame, said massage drive unit including an upright rotatable drive shaft having a lower end provided with a first gear and an upper end provided with a second gear, said massage drive unit further including a massaging roller assembly driven by axial rotation of said drive shaft for imparting a massaging action;

a first transmission belt coupled to said motor and said first gear so as to enable said motor to drive said drive shaft to rotate axially, rotation of said drive shaft resulting in corresponding rotation of said second gear;

a coupling unit mounted on said upper frame part of said slide frame, said coupling unit including a rotary member coupled threadedly and rotatable relative to said screw shaft, and driven rotatably by said second gear about axis of said screw shaft, thereby enabling said rotary member to move upwardly and downwardly along said screw shaft to result in corresponding upward and downward movement of said slide frame relative to said guide rails.

2. The massage apparatus of claim 1, further comprising a second transmission belt for coupling together said second gear and said rotary member.

3. The massage apparatus of claim 2, wherein:

said frame member further has a top frame section interconnecting top ends of said guide rails, and having an intermediate portion with an upper shaft mounting plate mounted thereon, said upper shaft mounting plate being formed with an upper first notch that opens at a peripheral edge of said upper shaft mounting plate, and a bottom frame section interconnecting bottom ends of said guide rails, and having an intermediate portion with a lower shaft mounting plate mounted thereon, said lower shaft mounting plate being vertically aligned with said upper shaft mounting plate and being formed with a lower first notch that is registered vertically with said upper first notch and that opens in a same direction as said upper first notch at a peripheral edge of said lower shaft mounting plate; and said screw shaft has top and bottom end portions, each of which is extended through a respective one of said upper and lower first notches from said peripheral edge of a respective one of said upper and lower shaft mounting plates.

4. The massage apparatus of claim 3, wherein said rotary member is formed with a screw hole therethrough for threaded engagement with said screw shaft, and has an outer surface formed with a belt engaging groove for engagement with said second transmission belt, said coupling unit further including:

a bracket mounted on said upper frame part of said slide frame, said bracket having parallel upper and lower bracket parts, each of said upper and lower bracket parts being formed with a second notch that is registered vertically with said upper and lower first notches and that opens in the same direction as said upper and lower first notches, said rotary member being disposed between said upper and lower bracket parts such that said screw shaft extends through said second notches in said upper and lower bracket parts;

a pair of bearing members provided respectively on upper and lower ends of said rotary member; and a pair of cap members enclosing respectively said bearing members, said cap members being retained removably and respectively on said upper and lower bracket parts, and retaining rotatably said rotary member between said upper and lower bracket parts.

5. The massage apparatus of claim 4, wherein each of said cap members has a pair of radial lugs, said coupling unit further including two pairs of screw members, one of said pairs of screw members extending through said upper bracket part and engaging said radial lugs on one of said cap members, the other one of said pairs of screw members extending through said lower bracket part and engaging said radial lugs on the other one of said cap members, said screw members retaining removably said cap members on said upper and lower bracket parts.

6. The massage apparatus of claim 4, wherein each of said top and bottom end portions of said screw shaft is provided with a screw fastener for securing releasably said top and bottom end portions of said screw shaft on said upper and lower shaft mounting plates, respectively.

* * * * *